US006308110B1

(12) United States Patent
Fromherz

(10) Patent No.: US 6,308,110 B1
(45) Date of Patent: Oct. 23, 2001

(54) APPARATUS AND METHOD OF DISTRIBUTED OBJECT HANDLING

(75) Inventor: Markus P. J. Fromherz, Palo Alto, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/449,341

(22) Filed: Nov. 24, 1999

(51) Int. Cl.[7] ..... G06F 7/00

(52) U.S. Cl. ..... 700/228; 700/255; 700/213; 198/341.05; 198/502.3

(58) Field of Search ..... 700/213, 228, 700/229, 255; 198/341.05, 502.3

(56) References Cited

U.S. PATENT DOCUMENTS 5,060,090 * 10/1991 Kobayashi et al. ..... 360/71
5,274,242 * 12/1993 Dragon et al. ..... 250/548
5,328,168 * 7/1994 Fox ..... 271/259
5,386,499 * 1/1995 Tokita ..... 395/85
5,768,141 * 6/1998 Hanaoka et al. ..... 364/478.02
5,988,857 * 11/1999 Ozawa et al. ..... 364/478.01
5,999,758 12/1999 Rai et al. .
6,002,890 12/1999 Jackson et al. .
6,161,058 * 12/2000 Nishijo et al. ..... 700/218

* cited by examiner

*Primary Examiner*—Christopher P. Ellis
*Assistant Examiner*—Khoi H. Tran
(74) *Attorney, Agent, or Firm*—Oliff & Berridge, PLC

(57) ABSTRACT

A modular object handling system has a multi-level control architecture, which includes a system controller that coordinates the functions and/or operations of individual module controllers, that in turn control corresponding actuators, to provide a desired system function. The system controller performs the overall trajectory planning by taking the constraints of each of the module actuators into account. The system controller may compensate for deviations of objects from their planned trajectories by contemporaneously redetermining trajectories and trajectory envelopes to encode the various combinations of the system constraints and task requirements. The trajectory envelopes can denote regions around other trajectories to indicate control criteria of interest, such as control and collision boundaries. However, by predetermining the trajectories and trajectory envelopes, and comparing the current state of an object with the predetermined trajectory envelopes, the system controller can even more quickly determine the extent to which the state satisfies the criteria. Thus, this system simplifies on-line determinations to merely include a comparison between a particular object, a particular trajectory and the corresponding trajectory envelope.

34 Claims, 5 Drawing Sheets

FIG. 1
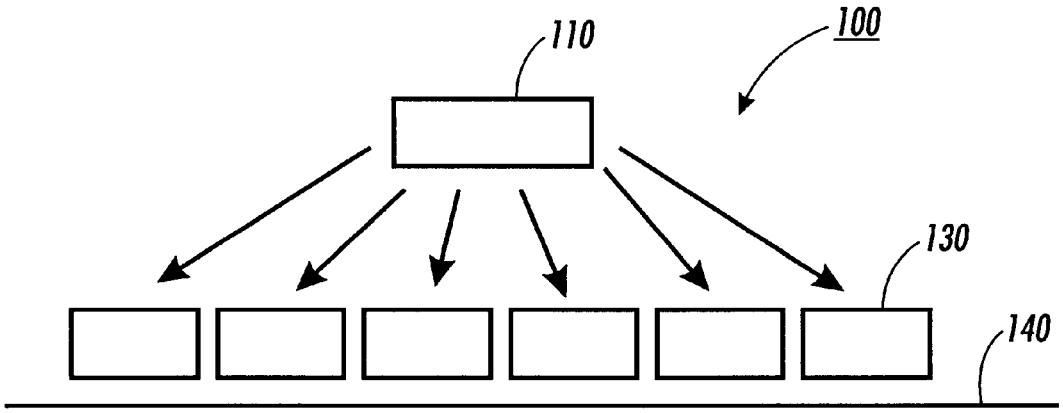
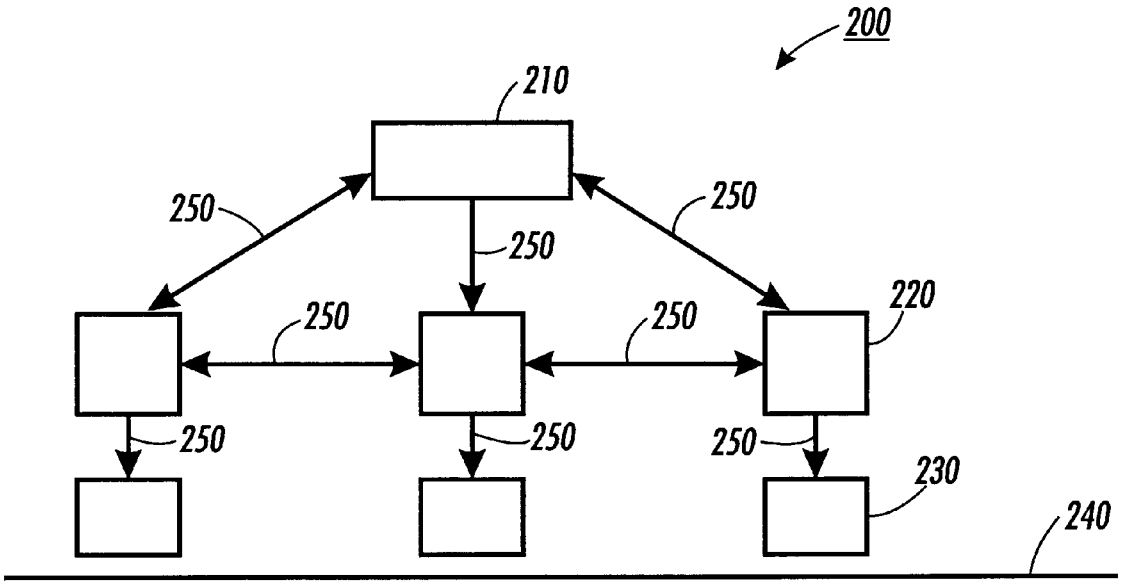
FIG. 2

FIG. 3
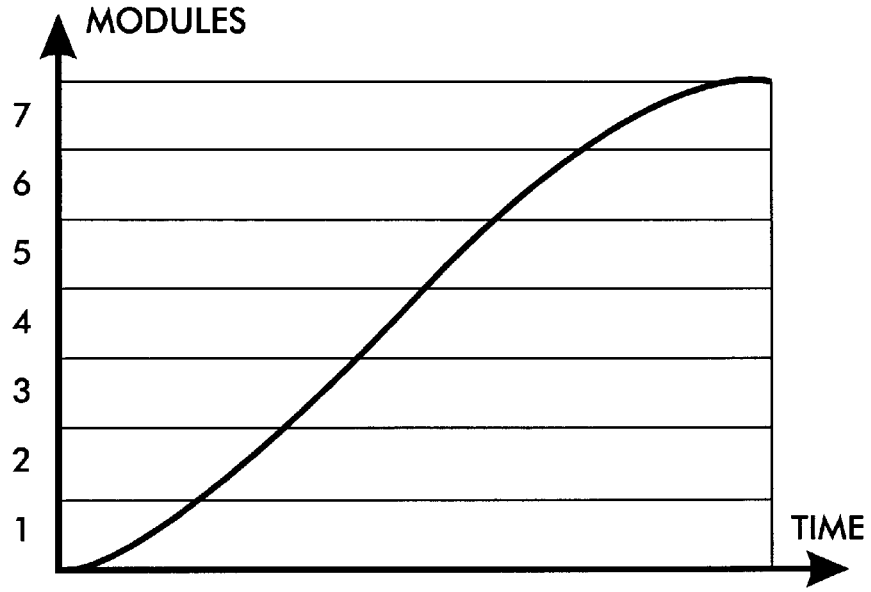
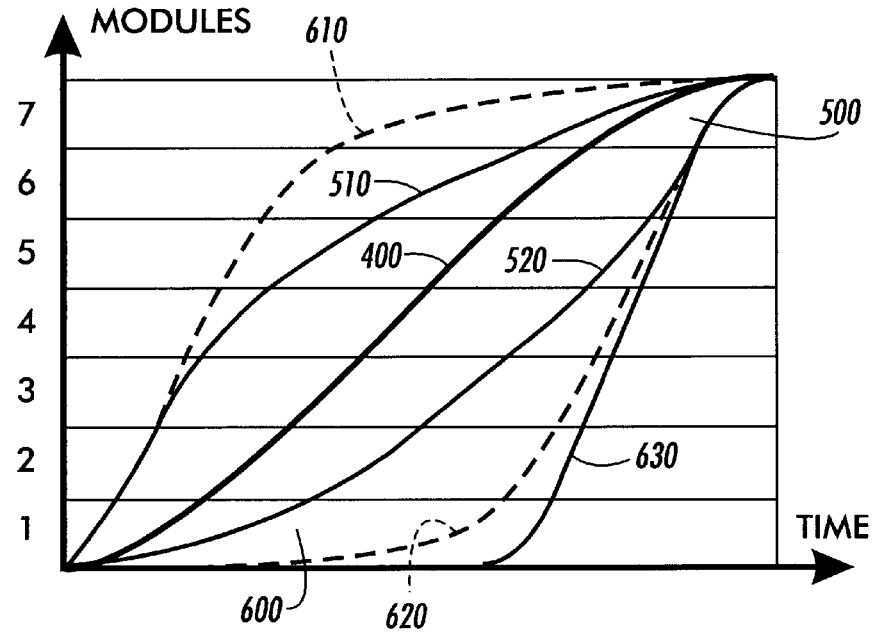
FIG. 4

APPARATUS AND METHOD OF DISTRIBUTED OBJECT HANDLING

BACKGROUND OF THE INVENTION

1. Field of Invention

This invention is directed to apparatus and methods of distributed object handling.

2. Description of Related Art

A traditional media handling system can move media, such as a sheet, from one location to another location along a path, while performing one or more operations on the sheet, such as inversion, image transfer or fusing. As shown in FIG. 1, a traditional media handling system 100 includes a controller 110 that controls multiple actuators 130, which perform operations on the sheet while moving the sheet along a paper path 140.

Typically, timing signals are used to coordinate the operations and sheet movement. For example, the sheet can be fed into the path 140 at a certain time according to a timing signal. The sheet can then move through the path 140, past various position sensors within a certain time window, and arrive at a transfer station at a specific time.

SUMMARY OF THE INVENTION

However, this traditional media handling system 100 is subject to the problem that when any temporal error in the operations beyond a certain tolerance is detected and flagged to the controller 110, the machine containing the traditional media handling system 100 is shut down. The traditional media handling system 100 does not include any feedback control. Thus, the actuators 130 need to be precisely manufactured, which is expensive. Also, because of this lack of feedback control, the traditional media handling system 100 does not perform well when subjected to different types of media, and has problems maintaining accuracy and reliability at high speeds.

A modular object handling system can overcome these problems via a more control-centric design, which can be accomplished by adding more controls. The use of control strategies, beyond the simple timing of the traditional media handling system 100, can also allow a wider range of objects, such as a wider range of media types, to be handled at higher speeds.

For example, a modular object handling system that includes a multi-level control architecture can provide advantages over the traditional media handling system 100 discussed above. This modular object handling system can include a system controller that coordinates the functions and/or the operations of individual module controllers, which in turn control corresponding actuators, to provide a desired system function, such as transporting objects along a path. In particular, the system controller can download an overall trajectory for each object to the module controllers. The module controllers can control their respective actuators to maintain each object on its planned trajectory while in that module.

The system controller performs the overall trajectory planning by taking the constraints of each of the module actuators into account. The trajectories planned by the system controller can then be provided as functions in distance-time space, such as cubic splines.

Deviations from an object's desired trajectory typically occur during the operation of the modular object handling system. For minor deviations, all control can be left to the individual module controllers, since they may not be concerned with other module controllers or whether the overall control criteria are satisfied. However, the system controller is concerned with satisfying the overall control criteria. Thus, the system controller may constantly monitor the location of the objects and contemporaneously redetermine the objects' trajectories using various control techniques to make up for such deviations.

However, continuously replanning trajectories by accessing complex trajectory re-determining techniques can be difficult to accomplish in real time. In fact, depending on the equipment and software involved, it may be necessary to resort to approximate determinations and heuristics to identify the effects of deviations and to replan the deviating trajectories in real time.

Thus, instead of continuously replanning the deviating trajectories, it may be desirable to use predetermined trajectories and trajectory envelopes to encode the various combinations of system constraints and task requirements. The trajectory envelopes can denote regions around other trajectories to indicate control criteria of interest, such as control and collision boundaries. By comparing the current state of an object with the predetermined trajectory envelopes, the system controller can quickly determine the extent to which the current state satisfies the control criteria.

For example, instead of continuously checking the distance between objects and re-determining the trajectories to avoid collisions, a predetermined collision envelope around the desired trajectory can be used. The predetermined collision envelopes are determined such that, as long as the objects are within their collision envelopes, the objects will not collide. A control envelope can similarly be used to determine other control criteria, such as whether the object will reach its target on time to accomplish a task requirement. This modular object handling system simplifies on-line determinations to merely include a comparison between a particular trajectory and the corresponding trajectory envelope, or between a current object position and a trajectory envelope.

These and other features and advantages of this invention are described in or are apparent from the following detailed description of various exemplary embodiments of the systems and methods according to this invention.

BRIEF DESCRIPTION OF THE DRAWINGS

Various exemplary embodiments of systems and methods according to this invention will be described in detail, with reference to the following figures, wherein:

FIG. 1 is a block diagram of a traditional media handling system;

FIG. 2 is a block diagram of a modular object handling system in accordance with the invention;

FIG. 3 is a graph that shows a typical time-distance nominal trajectory;

FIG. 4 is a graph showing trajectories and trajectory envelopes for sample system and task constraints;

DETAILED DESCRIPTION OF PREFERRED EMBODIMENTS

Figure 5:
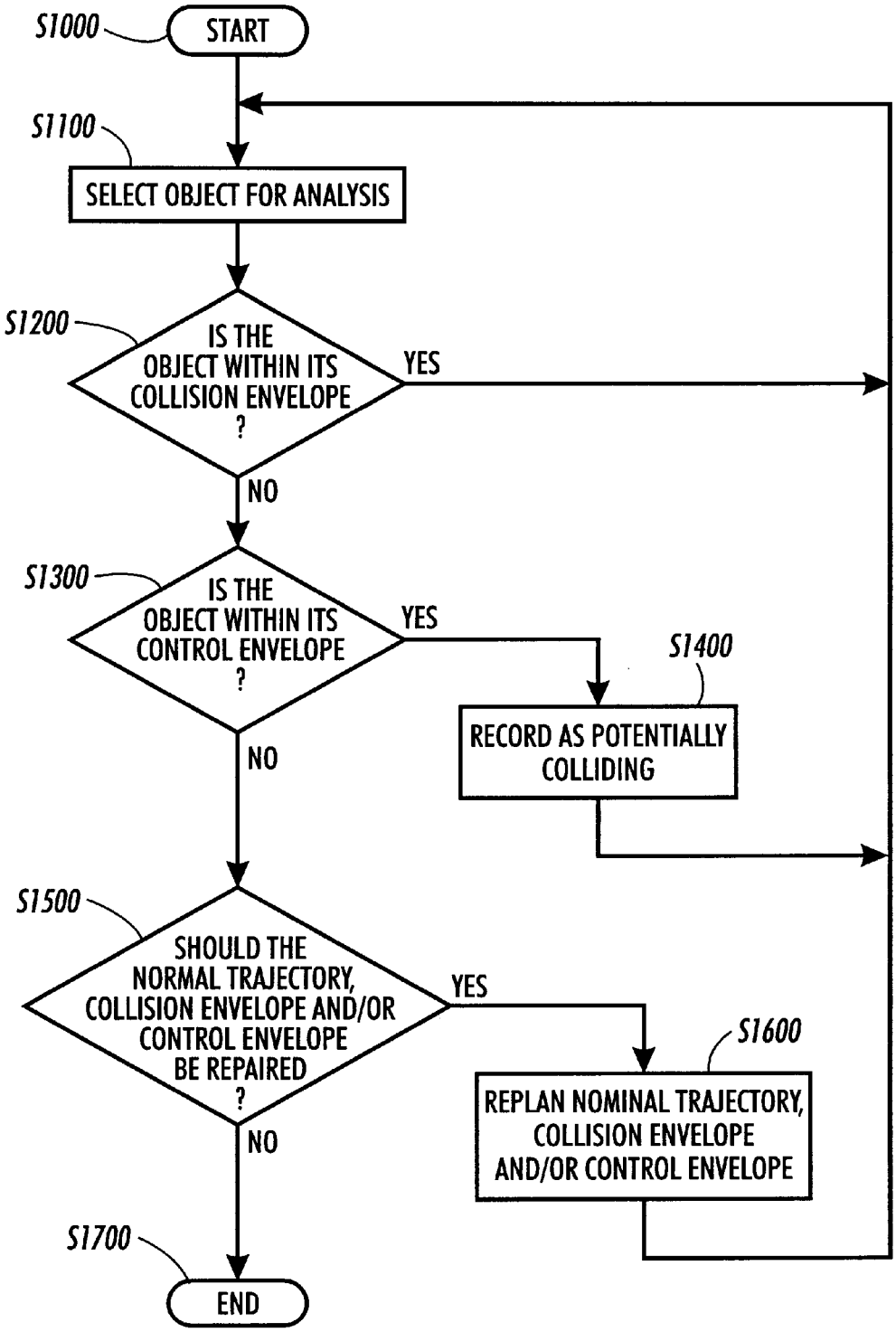
FIG. 5 is a flowchart outlining one exemplary embodiment of a method for using predetermined trajectories and trajectory envelopes in system level control of a multi-level modular object handling system.

FIG. 2 shows a modular object handling system 200 according to this invention that has a more control-centric design than the traditional media handling system 100. This modular object handling system 200 includes a system controller 210, one or more module controllers 220, one or more module actuators 230, and a path 240. The system controller 210 communicates with the module controllers 220 via communication links 250 to coordinate the functions and/or operations of the individual module actuators 230 to provide a desired system function, such as transporting multiple objects along the path 240 via the module actuators 230. The system controller 210 plans a trajectory of each object along the path 240, by taking into account a variety of system constraints and task requirements. The module controllers 220 control their respective module actuators 230 via communication links 250 to maintain each object on its planned trajectory. This control strategy can be referred to as multi-layered hierarchical control architecture.

In order to plan a trajectory while taking a variety of system constraints and requirements into account, it is helpful for the system controller 210 to be aware of certain data relating to the module controllers 220 and the module actuators 230. For example, the system controller 210 can be aware of entrance and exit points of each of the module actuators 230, a maximum accelerating and retarding force that can be applied to an object by each module actuator 230, and/or a response time of each module controller 220.

The system controller 210 downloads the planned trajectories for each object to the local module controllers 220 via the communication links 250. In one exemplary embodiment, the system controller 210 can download time-optimal trajectories to move objects at high speeds in the shortest possible time from one point to another point along the path 240 to enhance the productivity of the modular object handling system 200.

In the trajectories for the path 240, the object moves along the path 240 through regions where the object is subject to the control of several module actuators 230, the time-optimal trajectories can be implemented by each module actuator 230 either applying maximum actuation or minimum actuation with discrete switching between the two. This can be proven by considering an arbitrary modular object handling system 200 that includes n module actuators 230. Each module actuator 230 can apply a maximum acceleration a on the object using an array $A=[a_1, \ldots, a_n]$, where $a_n$ is the maximum acceleration of the nth module actuator 230. The n module actuators 230 can also apply a maximum retardation r on the object using an array $R=[r_1, \ldots, r_n]$, where $r_n$ is the maximum retardation of the nth module actuator 230. The object enters the path 240 at some velocity $v_0$ and leaves the path 240 at some velocity $v_n$.

Then, a desired trajectory, assuming that there are no other constraints, can be determined by first forward integrating the equations of motion of the object using the maximum accelerations for each module actuator, given the initial position and the initial velocity $v_0$. Then, the equations of motion of the object are backward integrated using the maximum retardations for each module actuator given the desired final position and velocity $v_n$. Next, the intersection points of the two trajectories, i.e., the switching times, are determined. In other words, the object moves forward under maximum acceleration from each module actuator 230 until the switching time, and then is retarded at maximum retardation by each module actuator 230 until that object reaches the final position and velocity.

As discussed above, the system controller 210 provides each module controller 220 with the trajectory for each object, which is usable by the module controller 220 to move the object once the object enters a region where the object is subject to control by the corresponding module actuator 230. Communicating the distance-time trajectory via the communication links 250 to each module controller 220 can be done by supplying a sequence of points on the trajectory. However, such a representation requires significant communication bandwidth, especially if the trajectory information has to be downloaded to all the module controllers 230 via the communication links 250, which may be several in number.

Since trajectories arc communicated to several module controllers 220 via the communication links 250 in real time, it is desirable to provide a compact and efficient representation of the trajectories that do not overload the communication links 250 and that are computationally efficient. For example, the trajectories can be conceived as functions in a distance-time space. In fact, these functions can be represented as expansions of general basis functions. Basis functions can be computationally efficient, and once known, the trajectories can be reconstructed. An example of such basis functions can be polynomials, such as, for example, polynomial spline basis functions. Such a representation significantly reduces the amount of floating point numbers that the system controller 210 needs to send down to the local control modules 220. Accordingly, high speed control is enabled without bogging down networks of the communication links 250.

For example, the trajectories can be represented as cubic splines, wherein y(t) is position, v(t) is velocity and a(t) is acceleration of the object on the trajectory. The position, velocity and acceleration of the object on the trajectory can be represented as follows:

$$y(t)=a_0+a_1(t-t_0)+a_2(t-t_0)^2+a_3(t-t_0)^3;$$

$$v(t)=a_1+2a_2(t-t_0)+3a_3(t-t_0)^2;$$

and $$a(t)=2a_2+6a_3(t-t_0).$$

Where:

$a_0$, $a_1$, $a_2$ and $a_3$ are constants;

$t_0 \leqq t \leqq t_1$;

t is a specified time; and $t_0$ is a time prior to t.

Each of these splines can be represented as a curve on the cartesian plane from time $t_0$ to time $t_1$, wherein either the position y, the velocity v, or the acceleration a is represented on one axis, and the time t is represented on the other axis. The shape of each of the curves is determined by the constants $a_0$, $a_1$, $a_2$ and $a_3$.

Thus, once the constants $a_0$, $a_1$, $a_2$ and $a_3$ are known, any position y(t) can be evaluated along the curve defined by the above cubic spline. The spline v(t) representing the velocity of the object on the trajectory can then be provided by taking the derivative of the position y(t). Similarly, the spline a(t) representing the acceleration of the object on the trajectory can be provided by taking the derivative of the velocity v(t).

By selecting the initial time $t_0$ and the final time $t_1$, each of the constants become:

$$a_0=y_0;$$

$$a_1=v_0;$$

$$a_2 = \frac{\frac{3(y_1 - y_0)}{t_1 - t_0} - 2v_0 - v_1}{t_1 - t_0}; \text{ and } a_3 = \frac{v_0 + v_1 + \frac{2(y_0 - y_1)}{t_1 - t_0}}{(t_1 - t_0)^2}.$$

Where:

$y_0$ and $y_1$ are the positions of the object on the trajectory at times $t_0$ and $t_1$, respectively; and $v_0$ and $v_1$ are the velocities of the object on the trajectory at times $t_0$ and $t_1$, respectively.

The above representation of the constants $a_2$ and $a_3$ can be further simplified by representing the change in position between times $t_1$ and $t_0$, i.e., $y_1-y_0$, as l, and the total lapsed time between times $t_1$ and $t_0$, i.e., $t_1-t_0$, as d. The constants $a_2$ and $a_3$ thus become:

$$a_2 = \frac{3l/d - 2v_o - v_1}{d}; \text{ and } a_3 = \frac{v_o + v_1 - 2l/d}{d^2}.$$

The modular object handling system 200 can include a number of the module actuators 230. In this modular object handling system 200, the time that the object enters the first module actuator 230 is $t_{1-1}$ or $t_0$. The time that the object exits the last, i.e., $n_{th}$, module actuator 230, is $t_n$. Thus, the duration of the object in the modular object handling system 200 is $t_n-t_0$. The time that an object enters the $j^{th}$ module actuator 230 is $t_{j-1}$, and the time that the object exits the $j^{th}$ module actuator 230 is $t_j$. Thus, the time that the object is within the $j^{th}$ module actuator 230 is $t_j-t_{j-1}$.

For the interval $t_j-t_{j-1}$, which represents the time that the object is in the $j^{th}$ module actuator 230, the constants $a_0$, $a_1$, $a_2$ and $a_3$ can be determined so that the above-described splines represent the overall system trajectory, i.e., the trajectory of the object within the entire modular object handling system 200. However, if the overall system trajectory must be changed within the $j^{th}$ module actuator 230, then new constants $a_0$, $a_1$, $a_2$ and $a_3$ must be determined. The new trajectory will begin at $t_{j-1}$, and will be continuous and have continuous first derivatives with the old trajectory.

When the modular object handling system 200 is operating, multiple objects can move through the path along trajectories, which may be determined and represented as discussed above. Under these circumstances, one of the functions of the system controller 210 can be to apprehend situations where objects might collide and to avoid such collisions. The system controller 210 can detect collisions based on the relative position and velocities of the objects in the path 240.

In one exemplary embodiment of a method for detecting and avoiding collisions according to this invention, the system controller 210 keeps track of the objects as the objects move. If the objects become too close to each other, and at the same time have non-zero relative velocities, the system controller 210 can redefine the trajectories of the objects to ensure that the objects do not collide. If the maximum acceleration that the objects can be moved at by the module actuators 230 is bounded, and the acceleration is a(t), then a(t) $\epsilon[-a_{max}, a_{max}]$. The maximum relative acceleration is therefore:

$$a_{coll\text{-}avoid}=2a_{max}.$$

In accordance with this exemplary embodiment of the collision avoidance method, the system controller 210 continuously monitors the relative object spacing and relative object velocity for all objects and continuously updates the trajectory envelopes as outlined above. Whenever the system controller 210 determines that an object has moved too close to another object, the system controller 210 forces the local module controllers 220 to decrease the relative velocity of the appropriate objects by slowing down the trailing object. This is accomplished by changing the position-time reference trajectory via increasing the arrival time at the end of the appropriate module actuator 230. Thus, the objects are always kept in a safe region of the modular object handling system 200 by the system controller 210. If, despite repeated corrections, the objects still tend to move too close together, the system controller 210 brings all the objects to a graceful halt by gradually slowing down all of the objects.

As discussed above, the modular object handling system 200 shown in FIG. 2 tracks the objects using feedback control using the techniques outlined above. The local module controllers 220 accept the trajectories provided by the system controller 210 and control their respective module actuators 230 to keep the objects on the desired trajectories. The local module controllers 220 can also communicate with the system controller 210 and other local module controllers 220, if necessary, to keep the objects on their appropriate trajectories.

The module actuators 230 can perform various tasks. Each task has a corresponding description in the appropriate space-time The overall system trajectory planning is performed by keeping the constraints imposed by the task of each of the module actuators 230. For example, the dwell time of an object that is stationary within a module actuator 230 corresponds to a horizontal line in the distance-time trajectory. When an object is simultaneously in two module actuators 230, this situation can be described as a trajectory that has the same slope, i.e., velocity, in the distance region specified for both module actuators 230. The trajectory therefore operates to effectively encode the constraints involved in moving the object on the path 240.

The communication links 250 shown in FIG. 2 are used to communicate the trajectory information back and forth between the module controllers 220, the system controller 210 and/or any other intermediate controller (not shown) in the modular object handling system 200. This bi-directional flow of information allows real-time corrections to be made to the trajectories. This ensures that conflicts between the multiple objects in the path 240 are resolved. For example, if two objects begin to get too close, that situation is sensed and the trajectories are replanned appropriately either by the module controllers 220 themselves or by the system controller 210. The new trajectories are then communicated to the appropriate module actuators 230. The module actuators 230 in turn, change their actuation to track the new trajectory.

The modular object handling system 200 discussed above provides numerous advantages over the traditional, single controller, object handling systems 100. For example, using active feedback control to track trajectories allows different types of objects to be handled. The control techniques discussed above can have parameters that depend on the object properties, and can be adjusted in real time depending on the object types. This can be accomplished by inputting the object properties to the modular object handling system 200. This can alternatively be accomplished by the modular object handling system 200 selecting the object properties during operation.

For high productivity, it is desirable to move objects at higher speeds. The modular object handling system 200 uses feedback control to keep the objects on the desired trajectories. Using active sensing and feedback control helps to correct the deviations from the desired trajectories in real time, and allows the object to be moved with high accuracy.

Since the object movement is monitored in real time, any situation arising in which a collision or other disruptive event may occur is detected by the modular object handling system 200. The trajectories are replanned accordingly to avoid the collision or other disruptive event. If the situation cannot be corrected by simply replanning the trajectories, the modular object handling system 200 can be controlled to bring the objects moving along the path 240 to a graceful halt.

Finally, using more active feedback control to handle objects reduces the required accuracy of the module actuators 230. It is possible to handle objects with less precisely manufactured module actuators 230 since the accuracy is maintained by sensing and control. Because the cost of the system and module controllers 210 and 220 is becoming cheaper, while the cost of the precision hardware is fairly constant, the overall cost of the modular object handling system 200 will decrease over time.

During operation of the modular object handling system 200 discussed above, the trajectory provided by the system controller 210 for each object takes a subset of the constraints and requirements into account. A nominal trajectory, which can be the time-optimal trajectory discussed above, is provided to represent the normal desired behavior for a single object. As such, the nominal trajectory encodes all such relevant control criteria. The relevant control criteria can include physical constraints, such as maximum object velocities when within each module actuator 230, and task requirements, such as reaching a target position at a target time and at a target velocity.

The above-described modular object handling system 200 can be used to move any object. For example, the modular object handling system 200 can be a modular media handling system for use with sheets, such as a transport system in an analog or digital copier, printer or other image forming device. In such an exemplary embodiment of the modular object handling system 200, tasks performed by module actuators 230 can include moving sheets, inverting sheets, decurling sheets, transferring images and fusing. The nominal trajectory therefore encodes the control criteria of these tasks.

In another exemplary application, the modular object handling system 200 can be a flight control system in an aircraft. In this example, the system controller 210 could be ground based, and the module controllers 220 and module actuators 230 could be onboard the aircraft. Using predetermined trajectories and trajectory envelopes may be particularly beneficial in view of recent changes in the airline industry towards implementing free flight, which allows pilots to choose their own trajectories for certain routes. Thus, the collision envelopes can be used to avoid collisions with other aircraft, and the control envelopes can be used to ensure that the aircraft reaches its destination on time.

Using the modular object handling system 200 as a flight control system entails certain differences its use as a transport system in an image forming device. For example, in an image forming device, moving sheets are handled by stationary module actuators 230. However, in a flight control system, the module actuators are onboard the object, i.e., the aircraft. Thus, the constraints of an aircraft, such as dynamics, maximum acceleration of the aircraft's engines, etc., travel with the aircraft, while the constraints of a sheet, such as the maximum acceleration of a certain module actuator 230, depend on the location of the sheet within the image forming device In yet another exemplary application, the modular object handling system 200 can be an assembly line control system of a product assembly line, such as a newspaper printing press. In this example, the path 240 would be the assembly line, and the module actuators 230 would control regions along the assembly line. The nominal trajectories could be predetermined based on nominal performances of the module actuators 230.

FIG. 3 is a graph of a typical time-distance nominal trajectory for the lead edge of a sheet when the modular object handling system 200 is a modular recording media handling system of an image forming device and the objects are sheets of recording media. As discussed above, cubic splines constitute only one possible manner of representing the time-distance trajectories.

When the modular media handling system 200 is operating, the system controller 210 communicates relevant pieces of this nominal trajectory as reference trajectories to the module controllers 220. The system controller 210 delegates local control to the module controllers 220. For example, if the trajectory contains entry and exit times and velocities of each module actuator 230, then only these times and velocities have to be communicated to the corresponding module controllers 220. The module controllers 220 can then reconstruct the necessary information for the behaviors of the sheets between each sheet's entry and exit from the respective module actuators 230.

As discussed above, deviations from the nominal trajectory typically occur during the operation of the modular media handling system 200. For minor deviations from the nominal trajectory, all control can be left to the module controllers 220. The module controllers 220 do not need to be concerned with the behaviors of other module controllers 220 and other module actuators 230, and those sheets outside of the module actuators 230 that are under the control of such other module controllers 220 and module actuators 230. The module controllers 220 also do not need to be concerned with whether the overall control criteria are satisfied, such as whether the target time will be met, or whether sheets are about to collide.

In contrast, the system controller 210 is concerned with the behaviors of the module actuators 230 and whether the overall control criteria are satisfied. When the behaviors of one or more module actuators 230 deviate from the expected behaviors, the system controller 210 determines what is happening, the potential effects, and how to correct or compensate for these deviations. In particular, deviation from the nominal trajectory may violate the constraints and requirements described above, which could lead to sheet collision, missing the target, or violating one or more optimality criteria. Thus, if a sheet is delayed within a module actuator 230, the system controller 210 has to determine whether subsequent sheets might collide, inform the relevant module controllers 220 involved, and possibly even generate new trajectories.

One primary duty of the system controller 210 is to determine which control criteria are violated. The system controller 210 can determine the status of various control criteria. For example, the system controller 210 could determine whether the objects are on track. This can be determined by checking whether the behavior of the module actuator 230 is sufficiently close to the nominal trajectory. If so, no further monitoring is required.

Determining the status of the control criteria, as well as identifying and reacting to the determined states, may require complex determinations, such as the various techniques discussed above, and can involve constraints from multiple module actuators 230 and sheets. Some problems, such as determining whether the target can still be reached, could even require replanning the entire trajectory from the current position, which may be difficult to accomplish in real time. Thus, since the control routines are continuously being performed, in order to respond in real time, the system controller 210 may have to resort to approximate determination and heuristics to identify the effects of deviations and to replan trajectories.

It may therefore be desirable to provide system-level control and monitoring systems and methods that replace these expensive and complex methods with simpler systems and methods for retrieving, combining and comparing trajectories and trajectory envelopes.

This can be accomplished by using predetermined trajectories and trajectory envelopes encoding various combinations of the system constraints and task requirements. Trajectory envelopes denote regions around other trajectories that indicate control criteria of interest. For example, instead of continuously checking the distance between objects to monitor the objects to avoid collisions, a predetermined collision envelope around the nominal trajectory can be used. Thus, as long as each object is within that object's collision envelope, the objects will not collide. The collision envelope can be determined in a similar manner as the safety region discussed above. However, instead of being continuously determined, the collision envelope can be determined prior to operation of the system.

In another exemplary embodiment, if an object deviates from its nominal trajectory, rather than replanning the trajectory for all module actuators 230 to determine whether the target can still be met, the modular object handling system 200 uses a control envelope. Thus, as long as an object remains within that object's control envelope, the object will still be able to reach the target. A trajectory envelope can be represented by one or more trajectories, which would, for example, denote the borders of the region of interest.

Thus, predetermined trajectory envelopes can be used to encode the control criteria of interest, together with multiple predetermined trajectories that denote control and collision boundaries. Different trajectory envelopes represent different control criteria. By comparing the current state (position, velocity, etc.) of an object with those predetermined trajectory envelopes, the system controller 210 is able to quickly determine the extent to which the state satisfies the criteria. The comparison operator depends on what the trajectory envelope encodes. For example, with a time-distance trajectory envelope, provided in a format similar to the nominal trajectory shown in FIG. 3, the system controller 210 only needs to test whether an object's position at the current time is to the left or right of the envelope boundary. Because those of ordinary skill in the art will be able to readily appreciate how to compare the current position of an object to the predetermined trajectory envelopes for different space-times, from the above description of a distance-time space, a detailed description of such comparisons is omitted.

The trajectories and trajectory envelopes can be determined using any appropriate known or later devised method. For example, the trajectories and trajectory envelopes can be arrived at in accordance with the determinations used to determine appropriate control and collision safety regions, such as, for example, optimal control and collision safety regions.

Regardless of how the trajectories and the trajectory envelopes are determined, predetermining the trajectories and the trajectory envelopes simplifies the control routines to merely include a comparison between the trajectories and the trajectory envelopes. This allows the system controller 210 to avoid having to determine the trajectories and the trajectory envelopes in real time during operation of the modular object handling system 210.

FIG. 4 is a graph showing the trajectories and the trajectory envelopes for sample system and task constraints. For example, a nominal trajectory 400 is shown as approximately bisecting the distance-time plane FIG. 4 also shows a collision envelope 500 defined by an early collision trajectory 510, to the left of, i.e., prior in time to, the nominal trajectory 400, and a late collision trajectory 520, to the right of, i.e., after in time to, the nominal trajectory 400. The early collision trajectory 510 defines the earliest time that an object can depart from a certain point on the path 240 at a certain velocity and not collide with another object, such as the object immediately ahead of that object on the path 240. The late collision trajectory 520 constitutes the latest time that an object can depart from a certain point on the path 240 at a certain velocity and not collide with another object, such as the object immediately behind that object on the path. This early-late collision envelope 500 can thus be used to encode a certain minimum distance between a certain object and the objects preceding and succeeding that object. As long as the object stays within that object's collision envelope 500, and the preceding and succeeding objects do not deviate more than a minimum distance from their nominal trajectories, then the objects will not collide.

FIG. 4 also shows a control envelope 600 defined by an early control trajectory 610, to the left of, i.e., prior in time to, the nominal trajectory 400, and a late control trajectory 620, to the right of, i.e., after in time to, the nominal trajectory 400. The early control trajectory 610 constitutes the earliest time that an object can depart from a certain point on the path 240 at a certain velocity and still accomplish its task. The late control trajectory 620 constitutes the latest time that an object can depart from a certain point on the path 240 at a certain velocity and still accomplish its task. The early-late control envelope 600 can thus be used to encode a certain location at which the object must be located. As long as the object stays within that object's control envelope, then the object will be able to accomplish its task.

The above-described late control trajectory 620 constitutes the latest time that an object can depart from a certain point at a certain velocity and still accomplish its task, for an object that enters the first module actuator 230 at the same time that the object is scheduled to enter the first module actuator 230 according to the nominal trajectory 400. In other words, the late control trajectory 620 enters the first module actuator 230 at the same time as the nominal trajectory 400. However, FIG. 4 also shows a latest control trajectory 630 that constitutes that latest time that an object can enter the first module actuator 230 and still accomplish its task. Thus, the latest control trajectory 630 enters the first module actuator 230 after the nominal trajectory 400 enters the first module actuator 230.

Each of the trajectories 400, 510, 520, 610, 620, 630 and the trajectory envelopes 500, 600 can be represented as a sequence of tuples. For example, in a modular object handling system 200, where the $n^{th}$ module actuator 230 is the last module actuator 230, and the $j^{th}$ module actuator 230 is one of the module actuators 230 between the first and $n^{th}$ module actuators 230, the sequence of tuples can be represented as $t_0, v_0-t_1, v_1 \ldots, t_{j-1}, v_{j-1}-t_j, v_j \ldots, t_{n-1}, v_{n-1}-t_n, v_n$. In these tuples, $t_0$ and $v_0$ represent the time and velocity of an object entering the first module actuator 230, $t_1$ and $v_1$ represent the time and velocity of an object exiting the first module actuator 230, $t_{j-1}$ and $v_{j-1}$ represent the time and velocity of an object entering the $j^{th}$ module actuator 230, and $t_j$ and $v_j$ represent the time and velocity of an object exiting the $j^{th}$ module actuator 230. Similarly, $t_{n-1}$ and $v_{n-1}$, and $t_n$ and $v_n$, represent the entry and exit times and velocities of an object relative to the $n^{th}$, or last, module actuator 230.

In operation, each object is provided with an appropriate main nominal trajectory as its reference trajectory. The responsibility to maintain each object within that object's main nominal trajectory is distributed among the module controllers 220. That is, the module controllers 220 attempt to keep each object on its particular main nominal trajectory. The system controller 210 is then called repeatedly to assess the current state for all objects in a sequence and take action as necessary. In particular, the system controller 210 monitors object distances in the particular space-time, identifies collisions, delays objects to avoid collisions when feasible, and aborts the object's travel along the path 240 if the target can no longer be achieved. The significant real-time determinations are the comparisons of object positions with trajectories and other positions. This simple collision avoidance mechanism uses one trajectory envelope to identify possible collisions and other envelopes to check whether an object is still controllable. The system controller 210 can then instruct a module controller 220 locally to delay or advance a particular object by a certain amount.

The control systems and methods of this invention work particularly well if deviations are minor or uniform. In such a situation, all objects can be delayed in the same modules.

FIG. 5 is a flowchart outlining one exemplary embodiment of a method for using predetermined trajectories and trajectory envelopes in system level control of a multi-level modular object handling system. In this embodiment, the collision envelope is smaller than the control envelope, as shown in FIG. 4.

Beginning in step S1000, control continues to step S1100, where an object is selected for analysis. Once the object is selected, control continues to step S1200, where a determination is made whether the object is within its predetermined collision envelope, i.e., whether the object is likely to collide with either preceding or succeeding objects. If the object is within its predetermined collision envelope, control returns to step S1100 where another object is selected for analysis. A determination does not need to be made as to whether the object is within its control envelope, since as discussed above, the collision envelope is smaller than the control envelope. Thus, if the object is within its collision envelope, then it must also be within its control envelope. Alternatively, if the object is not within its collision envelope, control continues to step S1300.

In step S1300, a determination is made whether the object is within its control envelope, i.e., whether the object is likely to be able to accomplish its assigned task. If the object is within its control envelope, then control continues to step S1400. Otherwise, control jumps to step S1500. In step S1400, the object is recorded as potentially colliding. The potentially colliding record can then be used to make a subsequent selection of an appropriate predetermined collision envelope for other objects. Only then would it be necessary to compute the actual distance between the potentially colliding objects and to take action as indicated above, e.g., to delay one of the objects.

The object is potentially colliding since the object was determined in step S1200 as being outside of its collision envelope. However, since the object is determined in step S1300 as being within its control envelope, control then returns from step S1400 to step S1100 where another object is selected for analysis.

Alternatively, in step S1500, a determination is made whether the nominal trajectory, collision envelope and/or control envelope should be replanned. If so, control continues to step S1600. Otherwise, control jumps to step S1700. In step S1600, one or more of the nominal trajectory, collision envelope and/or control envelopes are replanned. This can also result in a modification of the system task requirements. Control then returns to step S1100, where another object is selected for analysis.

Alternatively, if it is determined that the nominal trajectory, collision envelope and/or control envelope should not be replanned, then control continues to step S1700 where the analysis is terminated.

Figure 6:
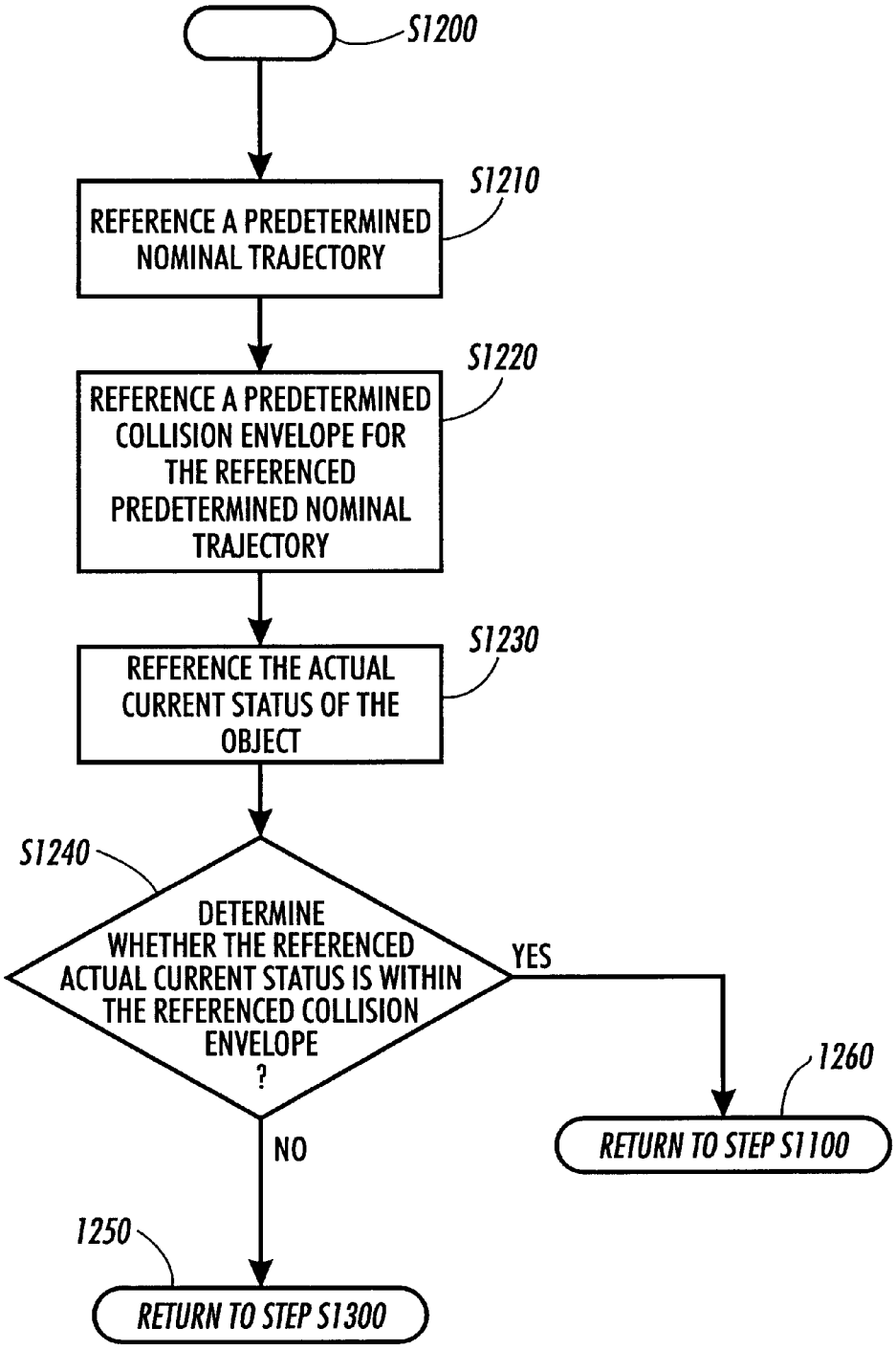
FIG. 6 is a flowchart outlining in greater detail one exemplary embodiment of a method for determining if the object is within its collision envelope of step S1200 of FIG. 5.

FIG. 6 is a flowchart outlining in greater detail one exemplary embodiment of a method for determining if the object is within its collision envelope of step S1200 of FIG. 5. Beginning in step S1200, control continues to step S1210, where a predetermined nominal trajectory for the object is referenced. Then, in step S1220, a predetermined collision envelope is referenced for the referenced predetermined nominal trajectory. Next, in step S1230, the actual current status, such as velocity, acceleration and/or position, of the object is referenced. Control continues to step S1240.

In step S1240, a determination is made whether the referenced actual current status of the object is within the referenced collision envelope for that time. If so, control returns to step S1100 of FIG. 5. If not, control returns to step S1300 of FIG. 5.

Figure 7:
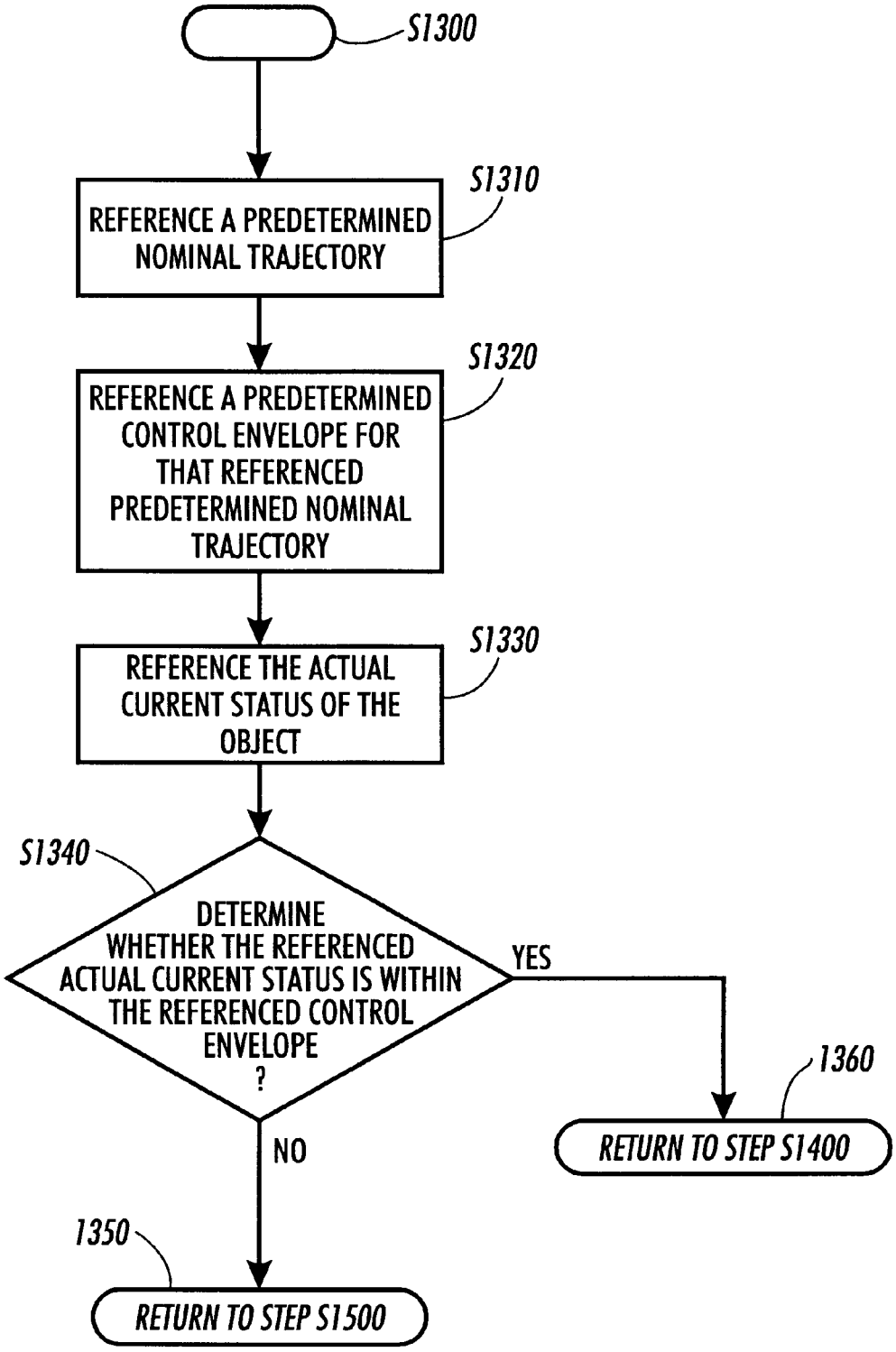
FIG. 7 is a flowchart outlining in greater detail one exemplary embodiment of a method for determining if the object is within its control envelope of step S1300 of FIG. 5.

FIG. 7 is a flowchart outlining in greater detail one exemplary embodiment of a method for determining if the object is within its control envelope of step S1300 of FIG. 5. Beginning in step S1300, control continues to step S1310, where a predetermined nominal trajectory of the object is referenced. This referenced predetermined nominal trajectory can be the same nominal trajectory of step S1200. Next, in step S1320, a predetermined control envelope is referenced for the referenced predetermined nominal trajectory. Then, in step S1330, the actual current status, such as velocity, acceleration and/or position, of the object is referenced. This actual current status of the object can be the same object status of step S1200. Control then continues to step S1340.

In step S1340, a determination is made whether the referenced actual current status of the object is within the referenced control envelope for that time. If so, control returns to step S1400 of FIG. 5. If not, control returns to step S1500 of FIG. 5.

In accordance with another exemplary embodiment of the methods for using predetermined trajectories and trajectory envelopes of this invention, the control envelope could be smaller than the collision envelope. A flowchart illustrating this alternative exemplary embodiment would be similar to the flowchart of FIG. 5, except that steps S1200 and S1300 would be juxtaposed. Thus, a first determination would be made whether the object is within its control envelope. If not, then a second determination would then be made whether the object is within its collision envelope.

The multilevel modular object handling systems discussed above can detect the actual current position of each object in accordance with any conceivable method or apparatus. For example, the actual position may be obtained via any type of detecting sensor. The actual position may also be estimated by a determination observer, such as a Luenberger observer, or alternatively a stochastic observer, such as a Kalman filter. The actual position may also be determined via a combination of actual sensing and estimation.

The module controllers 220 do not have to be completely subservient to the trajectories provided by the system controller 210. For example, module controllers 220 can be kept abreast of how close an object gets to one of the boundaries of a trajectory envelope and use that information to improve its efforts in achieving a task.

The trajectories and trajectory envelopes discussed above are discussed in terms of position, velocity and/or acceleration as functions of time. However, the trajectories and trajectory envelopes are not limited to these expressions, and can include any data relating to an object.

In the various exemplary embodiments discussed in detail above, the modular object handling systems use a two-layered hierarchical architecture, i.e., a single system controller and multiple module controllers. However, the modular object handling systems and methods according to this invention can use any number of layers of control, such as, for example, at least one intermediate control layer between the system controller and the module controllers. Moreover, the modular object handling systems and methods according to this invention can include multiple system controllers.

The modular object handling systems and methods according to this invention can include both predetermined collision and control envelopes. However, the modular object handling systems and methods according to this invention can use only predetermined collision envelopes or only predetermined control envelopes. Further, the predetermined trajectories and trajectory envelopes do not have to relate to collision and control borders and regions. Instead, the trajectories and trajectory envelopes can relate to any task or constraint. For example, multiple trajectory envelopes can be provided for different object sizes.

Also, in the various exemplary embodiments discussed in detail above, the modular object handling systems are described in terms of an object entering, exiting, or being within module actuators 230. However, the systems, trajectories and trajectory envelopes can also be described in terms of the object entering, exiting, or being within modules associated with each of the module actuators 230. Such modules could further be described as regions of the path 240 that are under the control of the module actuators 230.

The various controllers of the each of the multi-level modular object handling systems described above can be implemented using a programmed general purpose computer. However, the various controllers of the each of the multi-level modular object handling systems described above can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowcharts shown in FIGS. 5–7, can be used to implement the various controllers of the each of the multi-level modular object handling systems described above.

The communication links 250 can be any known or later developed device or system for connecting the system controller 210, module controllers 220, and the module actuators 230, including a direct cable connection, a connection over a wide area network or a local area network, a connection over an intranet, a connection over the Internet, or a connection over any other distributed processing network or system. In general, the communication links 250 can be any known or later developed connection system or structure usable to connect the system controller 210, module controllers 220, and the module actuators 230.

While the systems and methods of this invention have been described in conjunction with the specific embodiments outlined above, it is evident that many alternatives, modifications and variations will be apparent to those skilled in the art. Accordingly, the exemplary embodiments of the systems and methods of this invention, as set forth above, are intended to be illustrative, not limiting. Various changes may be made without departing from the spirit and scope of the invention.

What is claimed is:

1. A method of handling objects, comprising:

determining a specified trajectory in a trajectory space for a specified object to accomplish a system function;

determining a trajectory envelope in a trajectory space for use with the specified trajectory to indicate criteria of interest by determining a collision envelope that is defined between an early collision boundary that indicates the earliest time that the specified object can embark from a location and not collide with another object, and a late collision boundary that indicates the latest time that the specified object can embark from the location and not collide with another object determining an actual position in a trajectory space of the specified object; and determining whether the actual position in a trajectory space of the specified object is within the trajectory envelope.

2. The method according to claim 1, wherein:

determining a specified trajectory includes predetermining the specified trajectory; and determining a trajectory envelope includes predetermining the trajectory envelope.

3. The method according to claim 2, wherein determining the trajectory envelope includes:

determining a collision envelope.

4. The method according to claim 2, wherein determining the trajectory envelope includes:

determining a control envelope.

5. The method according to claim 2, wherein determining a trajectory envelope includes:

determining a control envelope that is defined between an early control boundary that indicates the earliest time that the specified object can embark from a location and still accomplish a task, and a late control boundary that indicates the latest time that the specified object can embark from the location and still accomplish the task.

6. The method according to claim 2, wherein determining a trajectory envelope includes determining multiple trajectory envelopes to indicate different control criteria of interest.

7. The method according to claim 2, further comprising controlling the object based upon whether the actual position in the trajectory space of the specified object is within the trajectory envelope.

8. An object handling apparatus usable with objects that are movable along a path, comprising:

a device that determines an actual position in a trajectory space of a specified object;

at least one actuator that performs an operation on the specified object;

at least one module controller that controls the operation of the at least one actuator;

a system controller that plans a system function based on the operation of the at least one actuator and based on whether the actual position in the trajectory space of the specified object is within a trajectory envelope, the trajectory envelope indicating control criteria of interest relative to a specified trajectory in the trajectory space that accomplishes the system function and the trajectory envelope determines a collision envelope that is defined between an early collision boundary that indicates the earliest time that the specified object can embark from a location and not collide with another object, and a late collision boundary that indicates the latest time that the specified object can embark from the location and not collide with another object.

9. The object handling apparatus according to claim 8, further comprising a memory that stores a predetermined trajectory and a predetermined trajectory envelope.

10. The object handling apparatus according to claim 8, wherein the memory stores a collision envelope.

11. The object handling apparatus according to claim 8, wherein the memory stores a collision envelope that is defined between an early collision boundary that indicates the earliest time that the specified object can embark from a location and not collide with another object, and a late collision boundary that indicates the latest time that the specified object can embark from the location and not collide with another object.

12. The object handling apparatus according to claim 8, wherein the memory stores a control envelope.

13. The object handling apparatus according to claim 8, wherein the memory stores a control envelope that is defined between an early collision boundary that indicates the earliest time that the specified object can embark from a location and still accomplish a task, and a late collision boundary that indicates the latest time that the specified object can embark from the location and still accomplish the task.

14. The object handling apparatus according to claim 9, wherein the memory stores multiple trajectory envelopes that indicate different control criteria of interest.

15. The object handling apparatus according to claim 8, wherein the system controller controls the object based on whether the actual position in the trajectory space of the specified object is within the trajectory envelope.

16. The object handling apparatus according to claim 8, wherein the specified trajectory is a nominal trajectory that defines desired behavior of the specified object.

17. The object handling apparatus according to claim 8, wherein the system function is transporting the specified object along a path.

18. The object handling apparatus according to claim 8, wherein the specified trajectory is a time-optimal trajectory that represents movement of the object through the path in a shortest amount of time.

19. The object handling apparatus according to claim 8, wherein the system controller downloads the specified trajectory to the at least one module controller, and the at least one module controller controls the at least one actuator to maintain the specified object on the specified trajectory.

20. The object handling apparatus according to claim 8, wherein the specified trajectory and the trajectory envelope are each represented as functions in a distance-time trajectory space.

21. The object handling apparatus according to claim 9, wherein the specified trajectory and the trajectory envelope are each represented as a cubic spline.

22. The object handling apparatus according to claim 9, wherein the system controller uses the specified trajectory and trajectory envelope to encode system constraints and task requirements of the apparatus.

23. The object handling apparatus according to claim 9, wherein the trajectory envelope includes a collision envelope and a control envelope.

24. The object handling apparatus according to claim 9, wherein the trajectory envelope includes a collision envelope and a control envelope, an area defined by the collision envelope being smaller than and contiguous with an area defined by the control envelope, such that when the system controller determines that the actual position of the specified object is within the collision envelope, then the actual position of the specified object must also be within the control envelope.

25. The object handling apparatus according to claim 24, wherein the system controller determines whether the actual position in the trajectory space of the specified object is within the collision envelope before analyzing the control envelope.

26. The object handling apparatus according to claim 25, wherein the system controller determines whether the actual position in the trajectory space of the specified object is within the control envelope only if the actual position in the trajectory space of the specified object is outside of the collision envelope.

27. The object handling apparatus according to claim 8, wherein the system controller and the at least one module controller communicate via a bi-directional flow of information.

28. The object handling apparatus according to claim 8, wherein a constraint of the apparatus includes maximum velocity of the specified object, and a task requirement includes the specified object reaching a target position at a target time with a target velocity.

29. The object handling apparatus according to claim 8, wherein the at least one module controller determines a deviation of the actual position of the specified object from the specified trajectory, and controls the at least one actuator to reduce the deviation.

30. The object handling apparatus according to claim 8, wherein the at least one module controller determines a proximity of the actual position of the specified object to boundaries that define the trajectory envelope, and controls the at least one actuator to accomplish the system function with improved efficiency based upon the proximity.

31. A method of handling objects, comprising:

determining a specified trajectory in a trajectory space for a specified object to accomplish a system function;

determining a trajectory envelope in a trajectory space for use with the specified trajectory to indicate criteria of interest;

determining an actual position in a trajectory space of the specified object;

determining whether the actual position in a trajectory space of the specified object is within the trajectory envelope; and determining a control envelope that is defined between an early control boundary that indicates the earliest time that the specified object can embark from a location and still accomplish a task, and a late control boundary that indicates the latest time that the specified object can embark from the location and still accomplish the task.

32. An object handling apparatus usable with objects that are movable along a path, comprising:

a device that determines an actual position in a trajectory space of a specified object;

at least one actuator that performs an operation on the specified object;

at least one module controller that controls the operation of the at least one actuator;

a system controller that plans a system function based on the operation of the at least one actuator and based on whether the actual position in the trajectory space of the specified object is within a trajectory envelope, the trajectory envelope indicating control criteria of interest relative to a specified trajectory in the trajectory space that accomplishes the system function; and a memory that stores a collision envelope that is defined between an early collision boundary that indicates the earliest time that the specified object can embark from a location and not collide with another object, and a late collision boundary that indicates the latest time that the specified object can embark from the location and not collide with another object.

33. An object handling apparatus usable with objects that are movable along a path, comprising:

a device that determines an actual position in a trajectory space of a specified object;

at least one actuator that performs an operation on the specified object;

at least one module controller that controls the operation of the at least one actuator;

a system controller that plans a system function based on the operation of the at least one actuator and based on whether the actual position in the trajectory space of the specified object is within a trajectory envelope, the trajectory envelope indicating control criteria of interest relative to a specified trajectory in the trajectory space that accomplishes the system function; and a memory that stores a control envelope that is defined between an early collision boundary that indicates the earliest time that the specified object can embark from a location and still accomplish a task, and a late collision boundary that indicates the latest time that the specified object can embark from the location and still accomplish the task.

34. An object handling apparatus usable with objects that are movable along a path, comprising:

a device that determines an actual position in a trajectory space of a specified object;

at least one actuator that performs an operation on the specified object;

at least one module controller that controls the operation of the at least one actuator;

a system controller that plans a system function based on the operation of the at least one actuator and based on whether the actual position in the trajectory space of the specified object is within a trajectory envelope, the trajectory envelope indicating control criteria of interest relative to a specified trajectory in the trajectory space that accomplishes the system function; and the trajectory envelope includes a collision envelope and a control envelope, an area defined by the collision envelope being smaller than and contiguous with an area defined by the control envelope, such that when the system controller determines that the actual position of the specified object is within the collision envelope, then the actual position of the specified object must also be within the control envelope.

* * * * *